United States Patent [19]

Bell et al.

[11] Patent Number: 4,755,683

[45] Date of Patent: Jul. 5, 1988

[54] LIQUID-METAL ION BEAM SOURCE SUBSTRUCTURE

[75] Inventors: Anthony E. Bell, McMinnville; Lynwood W. Swanson, Portland, both of Oreg.

[73] Assignee: Oregon Graduate Center, Beaverton, Oreg.

[21] Appl. No.: 104,410

[22] Filed: Oct. 5, 1987

[51] Int. Cl.[4] ..... H01J 27/02

[52] U.S. Cl. ..... 250/423 R; 250/425

[58] Field of Search ..... 250/423 F, 423 R, 425; 313/362.1; 315/111.81

[56] References Cited

U.S. PATENT DOCUMENTS 4,488,045 12/1984 Anazawa et al. ..... 250/423 R

*Primary Examiner*—Eugene R. LaRoche
*Assistant Examiner*—Steven J. Mottola
*Attorney, Agent, or Firm*—Kolisch, Hartwell & Dickinson

[57] ABSTRACT

A corrosion-resistant, long-life, high-capacity, power-efficient source substructure for a source of liquid-metal ions useable in focused-ion-beam apparatus. The substructure takes the form of an elongate carbon needle, pointed at one end, structurally supported entirely within the turns of an electrical heating coil having end leads which are conductively connected to, and structurally supported by, a pair of larger cross section electrical feeder legs.

5 Claims, 1 Drawing Sheet

LIQUID-METAL ION BEAM SOURCE SUBSTRUCTURE

BACKGROUND AND SUMMARY OF THE INVENTION

This invention pertains to a source substructure for use in field-emission-type, ion-beam generating devices.

In the recent past, this field of art has experienced widespread and growing interest in the use of so-called field-emission-type focused ion beams. Such beams are used for a number of purposes, such as for the micromachining of certain materials, for implantation of ions in the making of semiconductor devices, and in a number of other applications.

Generically speaking, in a typical liquid-metal ion source substructure there is a needle-like device, on the tip of which, during operation, is supported a film of a selected liquid metal fuel, or metal alloy, from which ions are emitted under the action of an intense, applied electrical field.

With respect to such a substructure, there are a number of important considerations. For example, many of the highly desirable metal fuels for liquid ions, such as fuels containing boron, are extremely corrosive to many potential source substructure materials, and it is important, therefore, to try to maximize corrosion resistance in order to have a substructure which offers a long useful lifespan. Another consideration is that a substructure should be designed in such a manner that it offers a high degree of power efficiency, so that a relatively low amount of power is required to heat the fuel properly to create the required liquid-metal melt pool. Desirable also is a substructure which is designed in such a fashion that it has a high fuel-holding capacity so that extended operating times are possible before metal replenishment is required.

In addition to these important considerations are also the following. The source substructure should offer a fairly high degree of rigidity in order to operate predictably and reliably with the usual associated electro-optical focusing apparatus. Further, the substructure should be as simple and inexpensive as possible.

A general object of the present invention, therefore, is to provide a unique liquid-metal ion-source substructure which takes all of the above-mentioned important considerations and requirements into account in a highly practical and satisfactory manner.

Thus, an object of the invention is to provide such a substructure which staunchly resists corrosion by ion-beam fuel materials, which requires extremely low power levels for proper operation, and which offers, as another significant contributor to long operating life cycles, a high fuel-metal holding capacity.

A further object of the invention, taking into account the considerations recited above, is to provide a substructure of the type generally outlined which is rigid, simple and extremely inexpensive.

According to a preferred embodiment of the invention, the proposed substructure takes the form of an elongate carbon needle which is tapered to a point at one end, and which is structurally supported entirely within the turns of an electrical contacting heating coil which has end leads that are conductively connected to and structurally supported by a pair of relatively large cross section electrical feeder legs. At least one, and preferably plural, elongate groove(s) extend along the length of the needle and into the tapered region to form significant reservoir space for enabling the substructure to hold a large quantity of metal source material.

These and other significant advantages and features which are offered by the substructure of the present invention will become more fully apparent as the description that now follows is read in conjunction with the accompanying drawings.

DETAILED DESCRIPTION OF THE INVENTION

Figure 1:
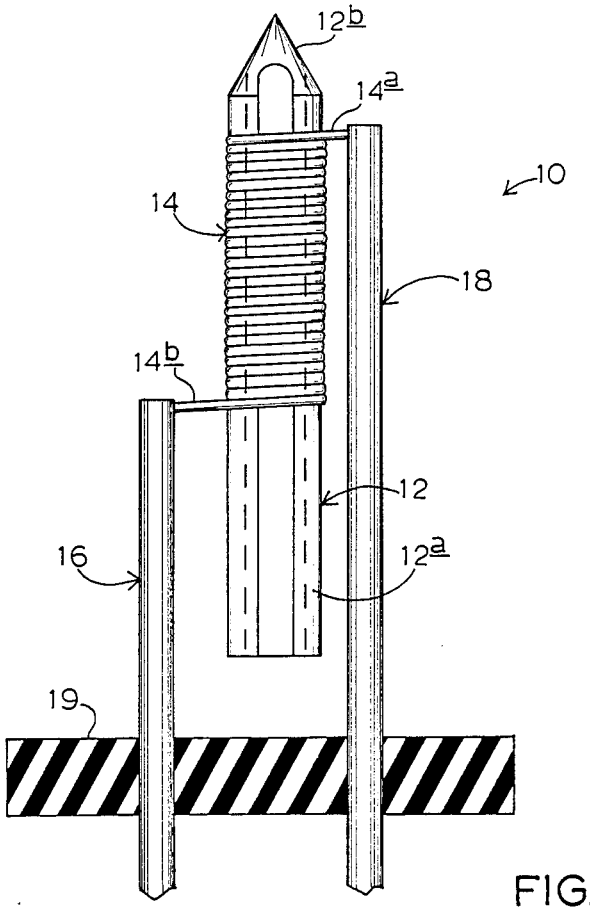
FIG. 1 is a side elevation showing a source substructure constructed in accordance with the present invention.

Turning now to the drawings, and referring first of all to FIG. 1, indicated generally at 10 is a liquid-metal ion-source substructure which is constructed in accordance with the present invention. In general terms, substructure 10 includes an elongate carbon needle 12 with (preferably) a cylindrical body 12*a* which tapers to a point adjacent end 12*b*. Needle 12 herein has an overall length of about 1.5-cm, and a diameter in body 12*a* of about 0.1-cm. End 12*b* is tapered at an angle of about 30° relative to the long axis of the needle, with the point of the taper having a radius of about 1- to 5-μm. Needle 12 is made of carbon, and thus is formed of a material which offers a high degree of corrosion resistance to all of the most corrosive of conventional liquid-metal ion fuels. In addition, it will be apparent that needle 12 is an extremely simple structure—one that is easy to fabricate in carbon.

Indicated at 14 in FIG. 1 is a combined electrical-heater/support wire coil which is wound tightly around the body of needle 12 below end 12*b* (in the figure). Preferably, coil 14, which includes around 20- to 30-turns is formed of tantalum, and has a wire diameter of about 0.25-mm. The close gripping contact which coil 14 makes with needle 12 furnishes both good rigid support for the needle, and good thermal conductivity with the needle. Tantalum is a preferred material for coil 14 on account of its relatively high melting point and low vapor pressure. Further, tantalum is preferred because it does not relax its gripping capability in any appreciable degree when heated to the required operating temperatures.

Coil 14 terminates in two short end leads 14*a*, 14*b* which each have a length of about 1.5-mm.

Further included in substructure 10 are two structural/conductive support legs 16, 18 that may be formed of any suitable conductive material which is easily bondable to the leads. In substructure 10, legs 16, 18 are formed of nickel, and have circular cross sections each with a diameter of about 0.5-mm. The upper ends of legs 16, 18 are suitably bonded, as by spot welding, to the outer extremities of leads 14*a*, 14*b*, respectively.

It should be noted that the cross-sectional areas of legs 16, 18 are significantly larger than the cross-sectional area of the wire forming coil 14. This is an important consideration in assuring that heat which is generated during the flow of current through the legs and the coil concentrates in the coil, and thus in the immediate area of needle 12. Legs 16, 18 are mounted on and extend through a thin cylindrical ceramic wafer 19.

The structure so far described and pictured in FIG. 1 may be mounted in any conventional manner in a typical ion-beam generating device, with the lower extremities of legs 16, 18 in FIG. 1 suitably supported and connected for electrical contact.

Figure 2:
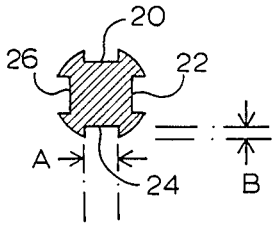
FIG. 2 is a cross-sectional view, on a larger scale than FIG. 1, taken generally along line 2—2 in FIG. 1.

Directing attention now to FIG. 2 along with FIG. 1, here it can be seen that, formed along the length of needle 12, and extending into the tapered end area of the needle, are four elongate grooves 20, 22, 24, 26. In substructure 10, each groove has a width A of about 0.25-mm and a depth B of about 0.125-mm. These grooves, in cooperation with one another, act as a reservoir for metal fuel material, and thus contribute the feature of high capacity referred to earlier. While different techniques may be used in the "loading" of needle 12 with fuel, we have found that a very satisfactory loading technique is to apply, as by brushing, a slurry of powdered fuel material in isopropanol. This is done in such a fashion that no slurry is applied to the apex of the conical portion of the needle itself. Next, the thus-coated needle is mounted in a vacuum system, and subjected to a electron-bombardment-heating at a voltage of about 1000-volts and a current of about 10-milliamperes. This technique melts the fuel powder on the outside first, and as this melt procedure continues, the molten fuel then satisfactorily wets the carbon needle. Once the needle is properly wetted, a subsequent application of slurry can be melted through simple resistance heating of the needle, by way of current flow in coil 14.

From the description which has just been given, it should be apparent that the various features and advantages of the invention which were discussed earlier as being important are clearly present. For example, the proposed carbon needle is an extremely simple structure, and also one which offers a high degree of corrosion resistance to typical, corrosive liquid-metal ion fuels. The grooves along the length of the needle contribute a high fuel-material reservoir capacity.

Another special feature in substructure 10 is that coil 14 acts both as a rigid support structure for needle 12, and as a closely thermally contacting heating element for the needle. With coil 14 constructed as illustrated, with short leads **14*a*, 14*b* supported on large cross-sectional area legs 16, 18, when current is introduced to heat the coil, and thus the needle, a major percentage of heat generation takes place in the contact interface between the coil and the needle. As a consequence, substructure 10 offers a very power efficient structure, and in tests has been shown to function very successfully with currents as low as 4- to 6-amperes at 2- to 3-volts for melt temperatures of about 1200° K. This low level of current flow is to be contrasted with today's conventional sources wherein currents of 20- to 30- or more amperes at 2- to 3-volts can be expected to be required for the same melting points. During operation, practice has shown that fuel material born by needle 12 does not exhibit a sufficient creep rate to pose any corrosion/attack problem for the material which makes up coil 14**.

Simplicity in substructure 10 yields, automatically, low expense in its construction. Corrosion resistance in the needle, and high reservoir capacity, contribute to long operating life and long operating cycles. With the needle construction described herein, the same will accommodate up to about 10-mg of fuel material, and last for use up to about 250-hours. The combination of legs 16, 18 and coil 14 furnishes adequate performance rigidity.

While a preferred embodiment of the invention has been described, it is appreciated that variations and modifications may be made without departing from the spirit of the invention.

It is claimed and desired to secure as Letters Patent:

1. A corrosion-resistant, long-life, high-capacity, power-efficient source substructure for a source of liquid-metal ions useable in focused-ion-beam apparatus comprising an elongate carbon needle having a body tapered adjacent one end to a point, a combined electrical-heater and support coil wrapped in gripping fashion about a portion of a length of said body which is spaced from said point, said coil including a pair of conductive and connective and support leads, and a pair of conductive support legs, one for each lead, joined conductively and structurally to the leads.

2. The substructure of claim 1, wherein said needle is formed with at least one elongate fuel-material reservoir groove extending at least along a portion of the length of the body and extending into the taper therein.

3. The substructure of claim 1, wherein said needle is formed with plural elongate fuel-material reservoir grooves extending at least along a portion of the length of the body and extending into the taper therein.

4. The substructure of claims 1, 2 or 3, wherein said legs have cross-sectional areas which are substantially larger than the cross-sectional area of a material forming said coil.

5. The substructure of claim 4, wherein said coil is formed from tantalum.

* * * * *